US009269369B2

(12) United States Patent
Lou et al.

(10) Patent No.: US 9,269,369 B2
(45) Date of Patent: Feb. 23, 2016

(54) METHOD AND DEVICE FOR DEREVERBERATION OF SINGLE-CHANNEL SPEECH

(71) Applicant: Goertek, Inc., Weifang, ShanDong Province (CN)

(72) Inventors: Shasha Lou, Weifang (CN); Xiaojie Wu, Weifang (CN); Bo Li, Weifang (CN)

(73) Assignee: Goertek, Inc., Weifang, Shandong Province (CN)

( * ) Notice: Subject to any disclaimer, the term of this patent is extended or adjusted under 35 U.S.C. 154(b) by 0 days.

(21) Appl. No.: 14/407,610

(22) PCT Filed: Apr. 1, 2013

(86) PCT No.: PCT/CN2013/073584

§ 371 (c)(1),
(2) Date: Dec. 12, 2014

(87) PCT Pub. No.: WO2013/189199

PCT Pub. Date: Dec. 27, 2013

(65) Prior Publication Data

US 2015/0149160 A1 May 28, 2015

(30) Foreign Application Priority Data

Jun. 18, 2012 (CN) ..... 2012 1 0201879

(51) Int. Cl.
*G10L 21/0208* (2013.01)

(52) U.S. Cl.
CPC ... *G10L 21/0208* (2013.01); *G10L 2021/02082* (2013.01)

(58) Field of Classification Search
CPC ..... G10L 19/02; G10L 19/028; G10L 19/03; G10L 21/003; G10L 21/02; G10L 21/0202; G10L 21/0205; G10L 21/0208; G10L 2021/02082; G10L 21/0216; G10L 21/0272; G10L 21/028; G10L 21/0364
See application file for complete search history.

(56) References Cited

U.S. PATENT DOCUMENTS 5,029,509 A * 7/1991 Serra et al. ..... 84/625
5,909,663 A * 6/1999 Iijima et al. ..... 704/226

(Continued)

FOREIGN PATENT DOCUMENTS

CN 1989550 6/2007
CN 101385386 3/2009
CN 102750956 10/2012

OTHER PUBLICATIONS

CN SN 201210201879.7—Notice of Decision of Granting Patent Right for Invention, 1 page, dated Apr. 1, 2014, and English Translation (1 Page).

(Continued)

*Primary Examiner* — Eric Yen
(74) *Attorney, Agent, or Firm* — Boyle Fredrickson, S.C.

(57) ABSTRACT

The present invention relates to a method and device for dereverberation of single-channel speech. The method includes the following steps of framing an input single channel speech signal, and processing the frame signals as follows according to a time sequence: performing short-time Fourier transform on a current frame to obtain a power spectrum and a phase spectrum of the current frame; selecting several frames previous to the current frame and having a distance from the current frame within a set duration range, and performing linear superposition on the power spectra of these frames to estimate the power spectrum of a late reflection sound of the current frame; removing the estimated power spectrum of the late reflection sound of the current frame from the power spectrum of the current frame by a spectral subtraction method to obtain the power spectra of a direct sound and an early reflection sound of the current frame; and performing inverse short-time Fourier transform on the power spectra of the direct sound and the early reflection sound of the current frame and the phase spectrum of the current frame together to obtain a signal of the current frame after dereverberation. The dereverberation method and device can solve the problem that the estimation of a transfer function of a reverberation environment or the estimation of reverberation time is difficult in the dereverberation of single-channel speech.

10 Claims, 4 Drawing Sheets

(56) References Cited

U.S. PATENT DOCUMENTS

| | | | | |
|---|---|---|---|---|
| 6,011,846 | A * | 1/2000 | Rabipour et al. | 379/406.06 |
| 6,261,101 | B1 * | 7/2001 | Benitz et al. | 434/167 |
| 6,496,795 | B1 * | 12/2002 | Malvar | 704/203 |
| 6,618,712 | B1 * | 9/2003 | Parker et al. | 706/15 |
| 8,160,262 | B2 | 4/2012 | Buck et al. | |
| 2001/0005822 | A1 * | 6/2001 | Fujii et al. | 704/200 |
| 2003/0033094 | A1 * | 2/2003 | Huang | 702/39 |
| 2004/0028222 | A1 * | 2/2004 | Sewell et al. | 380/28 |
| 2008/0059157 | A1 | 3/2008 | Fukuda et al. | |
| 2008/0292108 | A1 | 11/2008 | Buck et al. | |
| 2008/0300869 | A1 * | 12/2008 | Derkx et al. | 704/226 |
| 2009/0043570 | A1 * | 2/2009 | Fukuda et al. | 704/211 |
| 2009/0117948 | A1 * | 5/2009 | Buck et al. | 455/570 |
| 2009/0154726 | A1 * | 6/2009 | Taenzer | 381/94.1 |
| 2012/0177223 | A1 * | 7/2012 | Kanamori et al. | 381/94.7 |
| 2012/0328112 | A1 * | 12/2012 | Jeub et al. | 381/23.1 |
| 2013/0077798 | A1 * | 3/2013 | Otani et al. | 381/66 |

OTHER PUBLICATIONS

PCT/CN2013/073584, International Search Report, 3 pages, dated Jul. 18, 2013.

Kinoshita et al., "Suppression of Late Reverberation Effect on Speech Signal Using Long-Term Multiple-step Linear Prediction," IEEE Transactions on Audio, Speech, and Language Processing, vol. 17, No. 4, May 2009, 12 pages.

* cited by examiner

METHOD AND DEVICE FOR DEREVERBERATION OF SINGLE-CHANNEL SPEECH

TECHNICAL FIELD

The present invention relates to the field of speech enhancement, in particular to a method and device for dereverberation of single-channel speech.

BACKGROUND ART

In speech communications such as conference call or smart TV VoIP as the person who talks is far away from the microphone and the call environment is a relatively enclosed space, a signal received by the microphone may be easily interfered by reverberation in the environment. For example, in a room, as the speech is reflected by the surface of the wall, floor and furniture for many times, a signal received by the microphone side is a hybrid signal of a direct sound and a reflection sound. This part of reflection sound refers to reverberation signal. Heavy reverberation will result in unclear speech and thus influence the quality of call. Furthermore, interference from reverberation further degrades the performance of the acoustic receiving system and significantly degrades the performance of the speech recognition system.

The previous dereverberation methods usually employ deconvolution. In such methods, it is necessary to know the accurate shock response or transfer function of the reverberation environment (room or office etc.) in advance. The shock response of the reverberation environment may be measured in advance by a specific method or device, or estimated separately by other methods. Then, with the known shock response of the reverberation environment, an inverse filter is estimated, the deconvolution to the reverberation signals is realized, and the dereverberation is thus realized. Such methods have a problem that it is often difficult to obtain the shock response of the reverberation environment in advance and the process of acquiring the inverse filter itself may introduce in new unstable factors.

Another dereverberation method, as it does not require estimation of the shock response of the reverberation environment and thus does not require both calculation of an inverse filter and execution of inverse filtering, is also called as a blind dereverberation method. Such a method is usually based on speech model assumption. For example, reverberation results in change of the received voiced excitation pulse so that the periodicity becomes not so obvious. As a result, the clarity of speech is influenced. Such a method is usually based on a linear prediction coding (ITC) model, where it is assumed that the speech generation model is an all-pole model and reverberation or other additive noise introduces in new zero points in the whole system, the voiced excitation pulse is interfered, but the all-pole filter is not influenced. The dereverberation method is specifically as follows: the LPC residual of a signal is estimated, and then a clean pulse excitation sequence is estimated according to the pitch-synchronous clustering criterion or kurtosis maximization criterion, so as to realize dereverberation. Such a method has a problem that the calculation is usually highly complex and the assumption that only the all-zero filter is influenced by reverberation is sometimes inconsistent with the experimental analysis.

Dereverberation by a spectral subtraction method is a preferred solution. As a speech signal includes a direct sound, an early reflection sound and a late reflection sound, removing the power spectrum of the late reflection sound from the power spectrum of the whole speech by a spectral subtraction method may improve the quality of speech. However, the key point is the estimation of the spectrum of the late reflection sound, i.e., how to obtain a relatively accurate power spectrum of the late reflection sound to effectively remove the late reflection sound component while not distorting the speech. In the single-channel speech dereverberation, as there is only one path of microphone information available, the estimation of a transfer function of a reverberation environment or the estimation of reverberation time (RT60) is quite difficult.

SUMMARY OF THE INVENTION

The present invention provides a method and device for dereverberation of single-channel speech, to solve the problem that the estimation of a transfer function of a reverberation environment or the estimation of reverberation time is quite difficult.

The present invention discloses a method for dereverberation of single-channel speech, comprising the following steps of:

framing an input single-channel speech signal, and processing the frame signals as follows according to a time sequence:

performing short-time Fourier transform on a current frame to obtain a power spectrum and a phase spectrum of the current frame;

selecting several frames previous to the current frame and having a distance from the current frame within a set duration range, and performing linear superposition on the power spectra of these frames to estimate the power spectrum of a late reflection sound of the current frame;

removing the estimated power spectrum of the late reflection sound or the current frame from the power spectrum of the current frame by a spectral subtraction method to obtain the power spectra of a direct sound and an early reflection sound of the current frame; and performing inverse short-time Fourier transform on the power spectra of the direct sound and the early reflection sound of the current frame and the phase spectrum of the current frame together to obtain a signal of the current frame after dereverberation.

Preferably, an upper limit value of the duration range is set according to attenuation characteristics of the late reflection sound;

and/or a lower limit value of the duration range is set according to speech-related characteristics and shock response distribution areas of the direct sound and the early reflection sound in the reverberation environment.

Preferably, the upper limit value of the duration range is selected from 0.3 s to 0.5 s.

Preferably, the lower limit value of the duration range is selected from 50 ms to 80 ms.

Preferably, the performing linear superposition on the power spectra of these frames to estimate the power spectrum of a late reflection sound of the current frame specifically comprises:

performing linear superposition on all components in the power spectra of these frames, by using an autoregressive (AR) model, to estimate the power spectrum of the late reflection sound of the current frame;

or performing linear superposition on the direct sound and early reflection sound components in the power spectra of these frames, by using a moving average (MA) model, to estimate the power spectrum of the late reflection sound of the current frame;

or performing linear superposition on all components in the power spectra of these frames by using an autoregressive (AR) model, and then performing linear superposition on the direct sound and early reflection sound components in the power spectra of these frames by using a moving average (MA) model, to estimate the power spectrum of the late reflection sound of the current frame.

The present invention further discloses a device for dereverberation of single-channel speech, comprising:

a framing unit, configured to frame an input single-channel speech signal and output frame signals to a Fourier transform unit according to a time sequence;

the Fourier transform unit, configured to perform short-time Fourier transform on a received current frame to obtain a power spectrum and a phase spectrum of the current frame, output the power spectrum of the current frame to a spectral subtraction unit and a spectral estimation unit, and output the phase spectrum to an inverse Fourier transform unit;

the spectral estimation unit, configured to perform linear superposition on the power spectra of several frames previous to the current frame and having a distance from the current frame within a set duration range, estimate the power spectrum of a late reflection sound of the current frame, and output the estimated power spectrum of the late reflection sound of the current frame to the spectral subtraction unit;

the spectral subtraction unit, configured to remove the power spectrum of the late reflection sound of the current frame, which is obtained from the spectral estimation unit, from the power spectrum of the current frame obtained from the Fourier transform unit by a spectral subtraction method, to obtain the power spectra of the direct sound and the early reflection sound of the current frame, and output the power spectra of the direct sound and the early reflection sound of the current frame to the inverse Fourier transform unit; and the inverse Fourier transform unit, configured to perform inverse short-time Fourier transform on the power spectra of the direct sound and the early reflection sound of the current frame, which is obtained by the spectral subtraction unit, and the phase spectrum of the current frame, which is obtained by the Fourier transform unit, and output a signal of the current frame after dereverberation.

Preferably, the spectral estimation unit is specifically configured to set an upper limit value of the duration range according to attenuation characteristics of the late reflection sound; and/or, set a lower limit value of the duration range according to speech-related characteristics and shock response distribution areas of the direct sound and the early reflection sound in the reverberation environment.

Preferably, the spectral estimation unit is specifically configured to select the upper limit value of the duration range from 0.3 s to 0.5 s.

Preferably, the spectral estimation unit is specifically configured to select the lower limit value of the duration range from 50 ms to 80 ms.

Preferably, the spectral estimation unit is specifically configured to:

for several frames previous to the current frame and having a distance from the current frame within a set duration range, perform linear superposition on all components in the power spectra of these frames, by using an autoregressive (AR) model, to estimate the power spectrum of the late reflection sound of the current frame;

or for several frames previous to the current frame and having a distance from the current frame within a set duration range, perform linear superposition on the direct sound and early reflection sound components in the power spectra of these frames, by using a moving average (MA) model, to estimate the power spectrum of the late reflection sound of the current frame;

or for several frames previous to the current frame and having a distance from the current frame within a set duration range, perform linear superposition on all components in the power spectra of these frames by using an autoregressive (AR) model, and then performing linear superposition on the direct sound and early reflection sound components in the power spectra of these frames by using a moving average (MA) model, to estimate the power spectrum of the late reflection sound of the current frame.

The embodiments of the present invention have the following beneficial effects that: by selecting several frames previous to the current frame and having a distance from the current frame within a set duration range and performing linear superposition on the power spectra of these frames to estimate the power spectrum of a late reflection sound of the current frame, the power spectrum of the late reflection sound of the current frame may be estimated without requiring the estimation of a transfer function of a reverberation environment or the estimation of reverberation time, and dereverberation is further realized by spectral subtraction method. The operating complexity of dereverberation is simplified, and the implementation becomes simpler.

By setting a lower limit value of the duration range according to speech-related characteristics and shock response distribution areas of the direct sound and the early reflection sound in the reverberation environment, the useful direct sound and early reflection sound may be reserved better while dereverberating. The quality of speech is improved.

By setting an upper limit value of the duration range according to attenuation characteristics of the late reflection sound, the amount of superposition calculations is reduced while ensuring the accuracy of the estimated power spectrum of the late reflection sound.

In the embodiments of the present invention, the upper limit value is selected from 0.3 s to 0.5 s. This upper limit value is a threshold obtained by experiments. When the reverberation environment changes, even without adjustment to the upper limit value, a better dereverberation effect may be still obtained.

In the embodiments of the present invention, the lower limit value is selected from 50 ms to 80 ms. When the reverberation environment changes, even without adjustment to the lower limit value, superposition may be executed effectively out of the direct sound and the early reflection sound. As a result, the results of superposition include substantially no direct sound and early reflection sound. In this way, the useful direct sound and early reflection sound may be reserved better while dereverberating. Better quality of speech is obtained.

The change of the reverberation environment includes: from anechoic rooms without reverberation to halls with heavy reverberation.

DETAILED DESCRIPTION OF THE INVENTION

In order to make the objects, technical solutions and advantages of the present invention clearer, the embodiments of the present invention will be further described as below in details with reference to the drawings.

Figure 1:
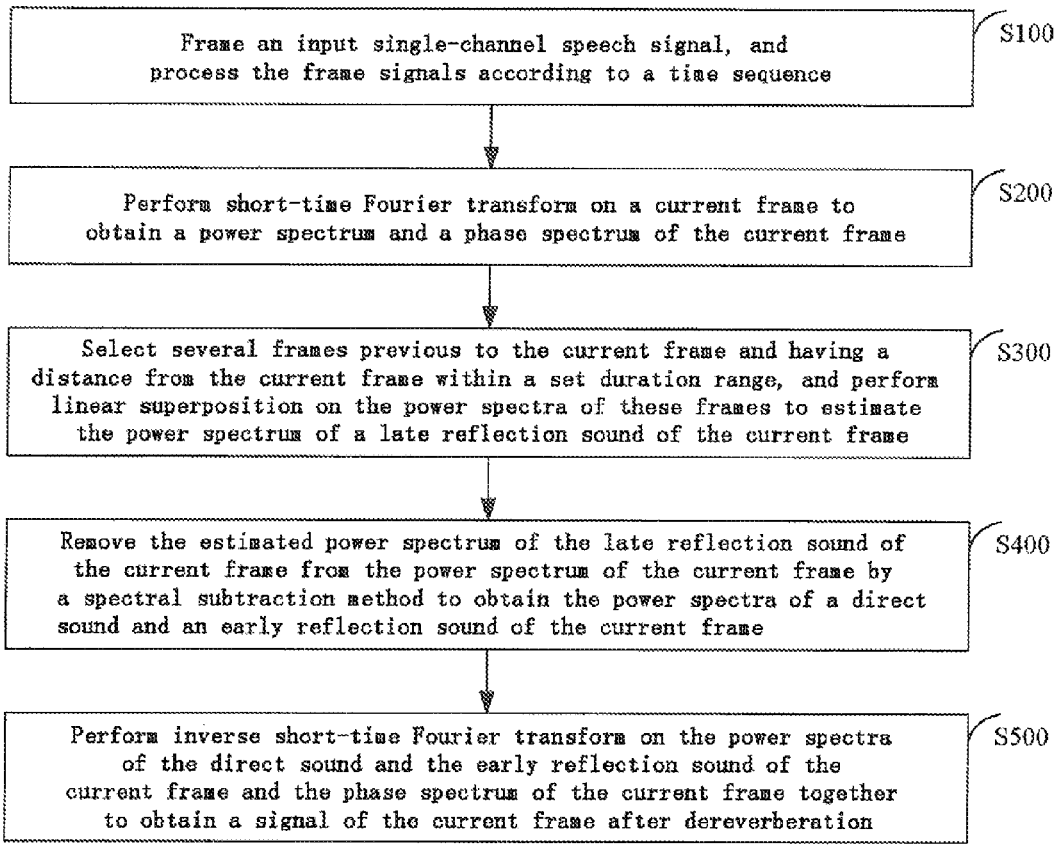
FIG. 1 is a flowchart of a method for dereverberation of single-channel speech according to the present invention.

Referring to FIG. 1, a flowchart of a method for dereverberation of single-channel speech according to the present invention is shown.

S100: An input single-channel speech signal is framed, and the frame signals are processed as follows according to a time sequence.

S200: Short-time Fourier transform is performed on a current frame to obtain a power spectrum and a phase spectrum of the current frame.

S300: Several frames previous to the current frame and having a distance from the current frame within a set duration range are selected, and linear superposition is performed on the power spectra of these frames to estimate the power spectrum of a late reflection sound of the current frame.

The several frames refer to a preset number of frames, which may be all frames in a duration range or a part of frames in the duration range.

S400: The estimated power spectrum of the late reflection sound of the current frame is removed from the power spectrum of the current frame by a spectral subtraction method to obtain the power spectra of a direct sound and an early reflection sound of the current frame.

S500: Inverse short-time Fourier transform is performed on the power spectra of the direct sound and the early reflection sound of the current frame and the phase spectrum of the current frame together to obtain a signal of the current frame after dereverberation.

In a reverberation environment, a signal x(t), i.e., a single-channel speech signal, acquired by the microphone is a hybrid signal of a direct sound and a reflection sound, which may be expressed by the following reverberation model:

$$x(t)=h*s(t)+n(t)$$

where, s(t) is a signal from a sound source, h is a room shock response between two points from the position of the sound source to the position of the microphone, * is convolution operation, n(t) is other additive noise in the reverberation environment.

Figure 2:
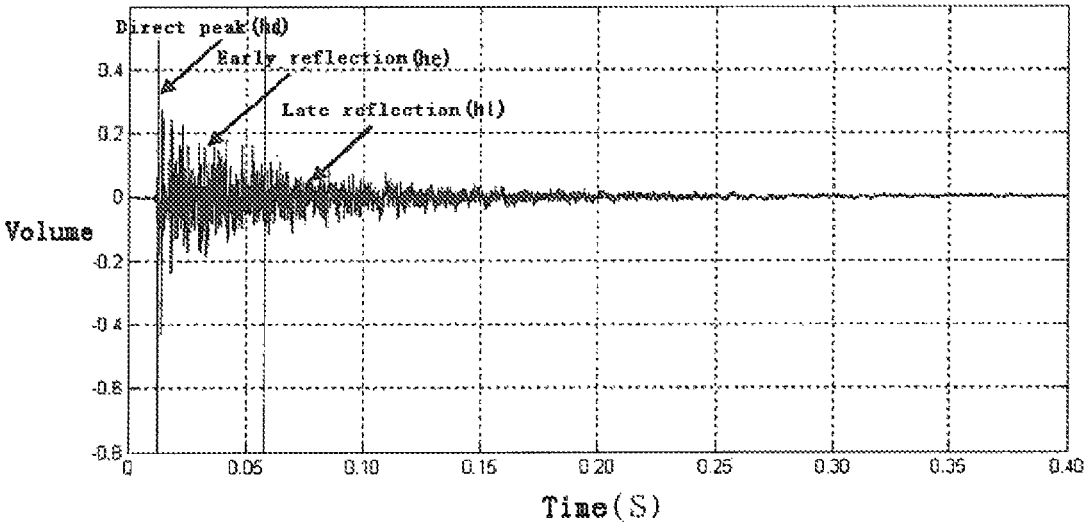
FIG. 2 is a schematic diagram showing shock response in a real room.

The shock response in a real room is as shown in FIG. 2. The shock response may be divided into three parts, i.e., direct peak hd, early reflection he and late reflection hl. The convolution of hd and s(t) may be simply considered as the reappearance of a signal from the sound source on the microphone side after a certain time delay, corresponding to the direct sound part in the x(t). The shock response of the early reflection part is corresponding to the part of a certain duration following hd, and the end time point of this duration is a certain time point from 50 ms to 80 ms. It is generally considered that the early reflection sound produced by the convolution of this part and s(t) may enhance and improve the quality of the direct sound. The shock response of the late reflection sound part is the remaining long trailing part of the room shock response after removal of hd and he. The reflection sound produced by the convolution of this part and signal s(t) is the reverberation component that will influence the hearing effects. The dereverberation algorithm is mainly to remove the influence of this part.

Therefore, the reverberation model may also be expressed as follows:

$$x(t)=(hd+he)*s(t)+hl*s(t)+n(t)$$

The hl part is consistent to the exponential attenuation model, approximately to the following equation:

$$hl(t) = b(t)e^{-\frac{3\ln 10}{T_r}t}$$

where, $T_r$ is reverberation time (RT60) of a reverberation environment, and b(t) is a zero-mean Gaussian distribution random variable.

How to estimate the power spectrum of a late reflection sound will be described in details as below.

From the analysis of power spectrum, the power spectrum X(t, f) of a signal may be expressed as follows:

$$X(t,f)=Y(t,f)+R(t,f)$$

where, R(t, f) is the power spectrum of a late reflection sound, while Y(t, f) is the power spectra of a direct sound and an early reflection sound which may be reserved. After the power spectrum R(t, f) of the late reflection sound is estimated, Y(t, f) may be estimated from X(t, f) by a spectral subtraction method, so that dereverberation may be realized.

According to the analysis of a reverberation generation model, the power spectrum of the late reflection sound may have a linear relationship with the power spectrum of a signal previous to the late reflection sound or some components in the power spectrum of a signal previous to the late reflection sound. Due to the speech characteristics of human beings, the power spectra of the direct sound and the early reflection sound have no linear relationship with the power spectrum of a signal previous to the direct sound and the early reflection sound or some components in the power spectrum of a signal previous to the direct sound and the early reflection sound. Therefore, by performing linear superposition on components in the power spectra of frames previous to the current frame and having a distance from the current frame within a set duration range, the power spectrum of the late reflection sound of the current frame may be estimated. Then, by removing the power spectrum of the late reflection sound from the power spectrum of the current frame by a spectral subtraction method, the dereverberation of single-channel speech may be realized.

Preferably, an upper limit value of the duration range is set according to attenuation characteristics of the late reflection sound.

If there are more frames used for spectral estimation, the estimation will become more accurate. However, too much frames will cause the increase of the amount of calculations. From FIG. 2 and the exponential attenuation model of the hl part, it can be known that the larger the distance from the current frame is, the smaller the energy of the reflection sound is, and the energy of the reflection sound may be ignored after a certain moment. Therefore, the moment when the energy of the reflection sound may be ignored is obtained according to the attenuation characteristics of the late reflection sound, and the upper limit value is set as duration from this moment to the moment of the current frame. In this way, the amount of superposition calculations may be reduced while ensuring the accuracy of the estimated power spectrum of the late reflection sound.

Preferably, a lower limit value of the duration range is set according to speech-related characteristics and shock response distribution areas of the direct sound and the early reflection sound in the reverberation environment.

From FIG. 2, it can be known that energy of both the direct sound and the early reflection sound is concentrated in time closer to the current frame. By setting a lower limit value of the duration range according to shock response distribution areas of the direct sound and the early reflection sound in the reverberation environment, linear superposition may be executed avoiding a time period in which energy of the direct sound and the early reflection sound is concentrated, and the useful direct sound and early reflection sound may be reserved better while dereverberating. The quality of speech is improved.

Preferably, the lower limit value of the duration range is selected from 50 ms to 80 ms.

It was found by experiments that, in various environments, as long as the lower limit value ranges from 50 ms to 80 ms, the effective power spectrum of the late reflection sound may be better estimated by sufficiently avoiding the direct sound and early reflection sound parts. When the environment changes, even without adjustment to the lower limit value, better quality of speech may be obtained.

Preferably, the upper limit value of the duration range is selected from 0.3 s to 0.5 s.

Theoretically, the setup of the upper limit value is related to a specific environment applying this method. In the estimation of the power spectrum of the late reflection sound related to the present invention, the upper limit value is theoretically corresponding to the length of the room shock response. However, in combination with the reverberation generation model and hl part of the shock response in a real environment attenuates according to an exponential model, the larger the distance from the current moment is, the smaller the energy of the reflection sound is, and the energy of the reflection sound may be ignored beyond 0.5 s. Therefore, actually, a rough upper limit value may be suitable to most reverberation environments. It has been proved that, when ranging from 0.3 s to 0.5 s, the upper limit value is quite suitable to various reverberation environments, such as anechoic room environments (reverberation time: very shorty, general office environments (reverberation time: 0.3-0.5 s), or even halls (reverberation time: >1 s), in an anechoic room environment, there is almost no late reflection sound. In the method provided by the present invention, as only the linear components are estimated and the period with the direct sound and early reflection sound concentrated is avoided, the effective speech components will not be removed even through the upper limit value is much longer than the reverberation time of the anechoic room. While in a hall environment, although the upper limit value may be smaller than the actual reverberation time, dereverberation may be well realized. This is because, as the shock response attenuates exponentially quickly, the late reflection sound components in the front 0.3 s occupy most of energy of the entire late reflection sound components.

In a specific implementation manner, the performing linear superposition on the power spectra of these frames to estimate the power spectrum of a late reflection sound of the current frame specifically comprises: performing linear superposition on all components in the power spectra of these frames, by using an AR (autoregressive) model, to estimate the power spectrum of the late reflection sound of the current frame.

For example, the power spectrum of the late reflection sound of the current frame is estimated by using the AR model according to the following equation:

$$R(t, f) = \sum_{j=J_0}^{J_{AR}} \alpha_{j,f} \cdot X(t - j \cdot \Delta t, f)$$

where, R(t, f) is the estimated power spectrum of the late reflection sound, $J_0$ is a stating order obtained from the lower limit value of the set duration range, $J_{AR}$ is an order of the AR model obtained from the upper limit value of the set duration range, $\alpha_{j,f}$ is an estimation parameter of the AR model, $X(t-j \cdot \Delta t, f)$ is the power spectrum of j frame previous to the current frame, and $\Delta t$ is an interval between frames.

In a specific implementation manner, the performing linear superposition on the power spectra of these frames to estimate the power spectrum of a late reflection sound of the current frame specifically comprises: performing linear superposition on the direct sound and early reflection sound components in the power spectra of these frames, by using an MA (Moving Average) model, to estimate the power spectrum of the late reflection sound of the current frame.

For example, the power spectrum of the late reflection sound of the current frame is estimated by using the MA model according to the following equation:

$$R(t, f) = \sum_{j=J_0}^{J_{MA}} \beta_{j,f} \cdot Y(t - j \cdot \Delta t, f)$$

where, R(t, f) is the estimated power spectrum of the late reflection sound, $J_0$ is a stating order obtained from the lower limit value of the set duration range, $J_{MA}$ is an order of the MA model obtained from the upper limit value of the set duration range, $\beta_{j,f}$ is an estimation parameter of the MA model, $Y(t-j \cdot \Delta t, f)$ is the power spectra of a direct sound and an early reflection sound of j frame previous to the current frame, and $\Delta t$ is an interval between frames.

In a specific implementation manner, the performing linear superposition on the power spectra of these frames to estimate the power spectrum of a late reflection sound of the current frame specifically comprises: performing linear superposition on all components in the power spectra of these frames by using an AR model, and then performing linear superposition on the direct sound and early reflection sound components in the power spectra of these frames by using an MA model, to estimate the power spectrum of the late reflection sound of the current frame.

For example, the power spectrum of the late reflection sound of the current frame is estimated by using the ARMA model according to the following equation:

$$R(t, f) = \sum_{j=J_0}^{J_{AR}} \alpha_{j,f} \cdot X(t - j \cdot \Delta t, f) + \sum_{j=J_0}^{J_{MA}} \beta_{j,f} \cdot Y(t - j \cdot \Delta t, f)$$

where, R(t, f) is the estimated power spectrum of the late reflection sound, $J_0$ is a stating order obtained from the lower limit value of the set duration range, $J_{AR}$ is an order of the AR model obtained from the upper limit value of the set duration range, $\alpha_{j,f}$ is an estimation parameter of the AR model, $J_{MA}$ is an order of the MA model obtained from the upper limit value of the set duration range, $\beta_{j,f}$ is an estimation parameter of the MA model, $Y(t-j\cdot\Delta t, f)$ is the power spectra of a direct sound and an early reflection sound of j frame previous to the current frame, $X(t-j\cdot\Delta t, f)$ is the power spectrum of j frame previous to the current frame and $\Delta t$ is an interval between frames.

There are well-known algorithms for the specific solutions of the AR model, the MA model and the ARMA model, for example, by Yule-Walker equations or Burg algorithm.

The key point of dereverberation by a spectral subtraction method is the estimation of the power spectrum of the late reflection sound. The estimation of the power spectrum of the late reflection sound mentioned in the prior art is usually a certain particular example of the AR or MA or ARMA model mentioned above. Furthermore, other methods of the estimation of the power spectrum of the late reflection sound usually require the estimation of reverberation time (RT60) in a reverberation environment at the speech intermittent stage, which is treated as an important parameter in the estimation of power spectrum of the late reflection sound. In this Patent, without requiring the estimation of reverberation time or the estimation of shock response in various environments, this method is suitable to various different reverberation environments and occasions where the reverberation shock response or reverberation time changes due to the movement of a person who is talking in a reverberation environment.

In a specific implementation manner, the removing the reverberation components from the power spectrum of the frame by a spectral subtraction method specifically comprises:

obtaining a gain function by a spectral subtraction method according to the power spectrum of the late reflection sound; and multiplying the gain function by the power spectrum of the current frame to obtain the power spectra of the direct sound and the early reflection sound of the current frame.

After finishing the estimation of the power spectrum R(t, f) of the late reflection sound, a speech signal Y(t, f) after dereverberation may be obtained by a spectral subtraction method:

$$Y(t,f)=G(t,f)\cdot X(t,f)$$

where, $$G(t, f) = \frac{X(t, f) - R(t, f)}{X(t, f)}$$

is the gain function obtained by a spectral subtraction method.

Figure 3A:
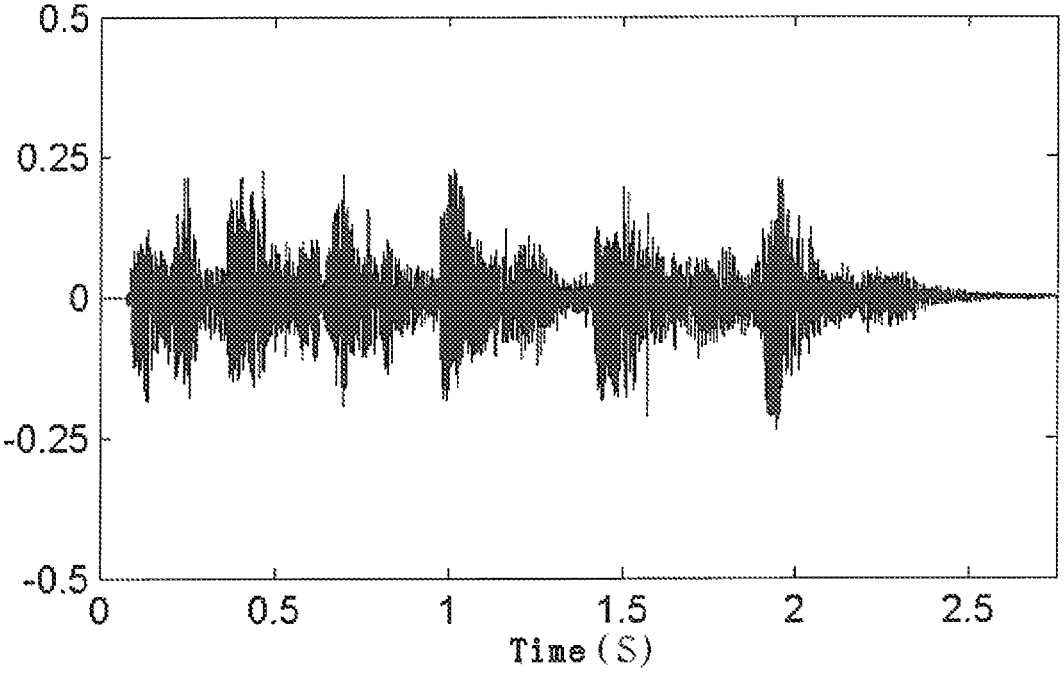
FIG. 3 is a schematic diagram of implementation effect of the present invention, FIG. 3(*a*) is a time domain diagram of a reverberation signal, FIG. 3(*b*) is a time domain diagram of a signal after dereverberation, and FIG. 3(*c*) is an energy envelope curve of a reverberation signal and a signal after dereverberation.
Figure 3B:
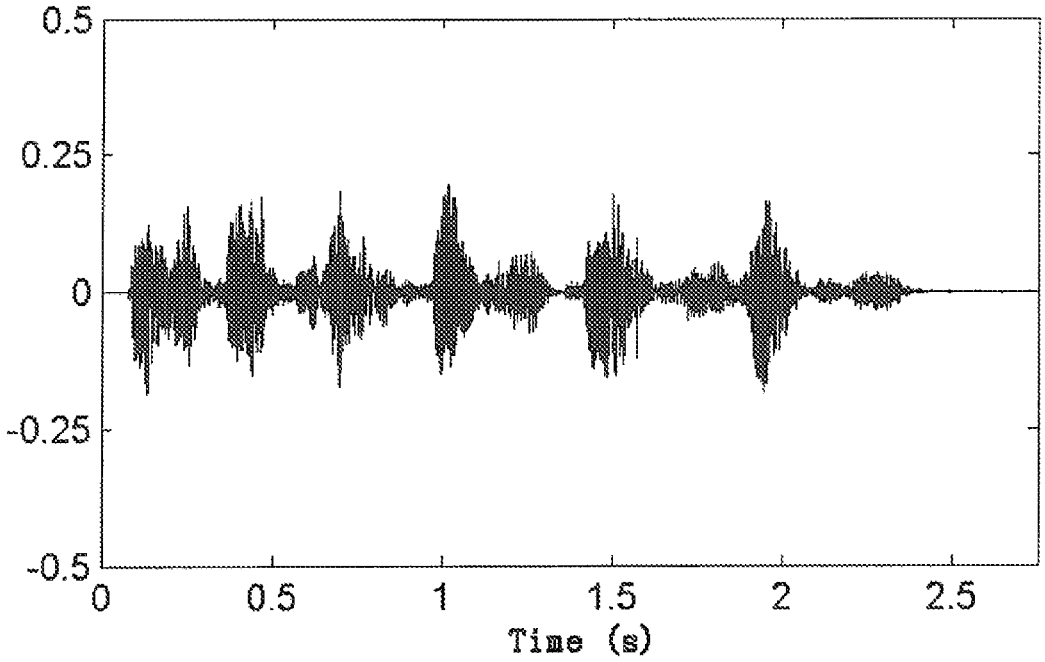
Figure 3C:
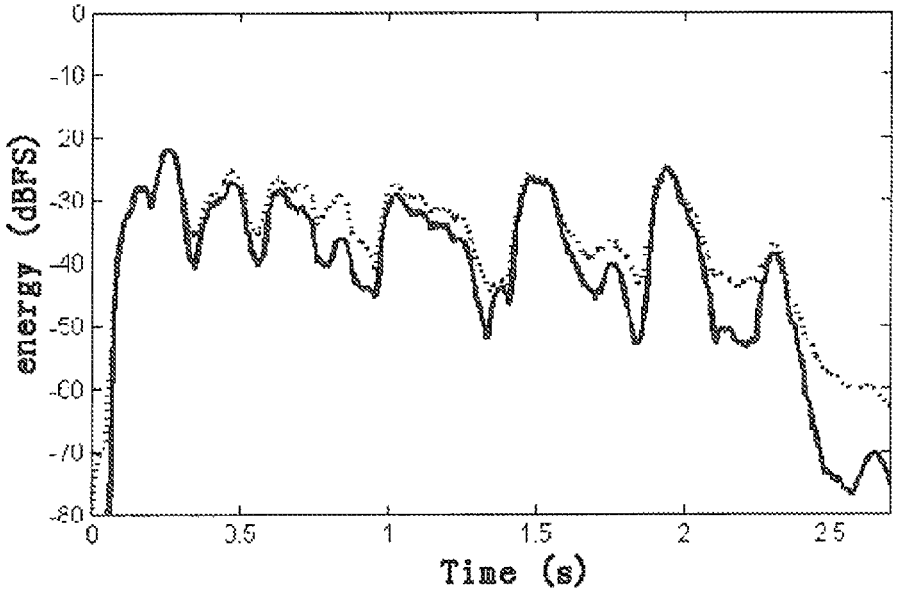

The implementation effect of this Patent is as shown in FIG. 3. A reverberation signal (single-channel speech signal) is acquired horn a conference room, the distance from the sound source to the microphone is 2 m, and the reverberation time (RT60) is about 0.45 s. The power spectrum of the late reflection sound is estimated according to the AR model set forth in the present invention, the lower limit value is set as 80 ms, and the upper limit value is set as 0.5 s. As shown, after dereverberation by using the method provided by the present invention, the reverberation trailing attenuates obviously, and the quality of speech is improved significantly.

Figure 4:
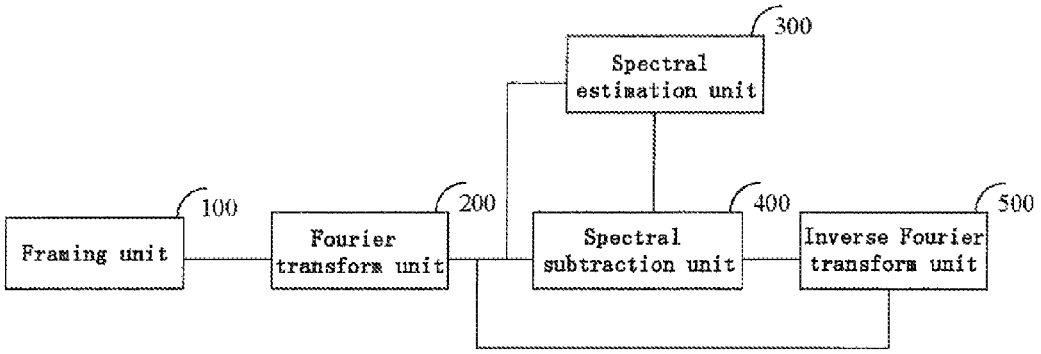
FIG. 4 is a structure diagram of a device for dereverberation of single-channel speech according to the present invention.

As shown in FIG. 4, the device for dereverberation of single-channel speech includes the following units:

a framing unit 100, configured to frame an input single-channel speech signal, and output frame signals to a Fourier transform unit 200 according to a time sequence;

the Fourier transform unit 200, configured to perform short-time Fourier transform on a received current frame to obtain a power spectrum and a phase spectrum of the current frame, output the power spectrum of the current frame to a spectral subtraction unit 400 and a spectral estimation unit 300, and output the phase spectrum to an inverse Fourier transform unit 500;

the spectral estimation unit 300, configured to perform linear superposition on the power spectra of several frames previous to the current frame and having a distance from the current frame within a set duration range, estimate the power spectrum of a late reflection sound of the current frame, and output the estimated power spectrum of the late reflection sound of the current frame to the spectral subtraction unit 400;

the spectral subtraction unit 400, configured to remove the power spectrum of the late reflection sound of the current frame, which is obtained from the spectral estimation unit 300, from the power spectrum of the current frame obtained from the Fourier transform unit 200 by a spectral subtraction method, to obtain the power spectra of the direct sound and the early reflection sound of the current frame, and output the power spectra of the direct sound and the early reflection sound of the current frame to the inverse Fourier transform unit 500; and the inverse Fourier transform unit 500, configured to perform inverse short-time Fourier transform on the power spectra of the direct sound and the early reflection sound of the current frame, which is obtained by the spectral subtraction unit 400, and the phase spectrum of the current frame, which is obtained by the Fourier transform unit 200, and output a signal of the current frame after dereverberation.

Preferably, the spectral estimation unit 300 is specifically configured to set an upper limit value of the duration range according to attenuation characteristics of the late reflection sound.

Preferably, the spectral estimation unit 300 is specifically configured to set a lower limit value of the duration range according to speech-related characteristics and shock response distribution areas of the direct sound and the early reflection sound in the reverberation environment.

Preferably, the spectral estimation unit 300 is specifically configured to select the upper limit value of the duration range from 0.3 s to 0.5 s.

Preferably, the spectral estimation unit 300 is specifically configured to select the lower limit value of the duration range from 50 ms to 80 ms.

Figure 5:
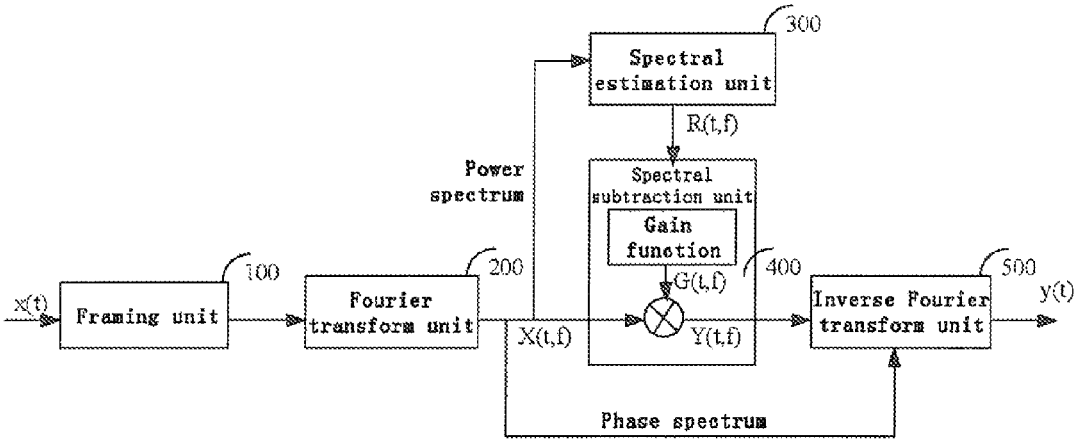
FIG. 5 is a structure diagram of a specific implementation manner of the device for dereverberation of single-channel speech according to the present invention.

The device in a specific implementation manner is as shown in FIG. 5. The spectral estimation unit 300 is specifically configured to: for several frames previous to the current frame and having a distance from the current frame within a set duration range, perform linear superposition on all components in the power spectra of these frames, by using an AR model, to estimate the power spectrum of the late reflection sound of the current frame.

For example, the power spectrum of the late reflection sound of the current frame is estimated by using the AR model according to the following equation:

$$R(t, f) = \sum_{j=J_0}^{J_{AR}} \alpha_{j,f} \cdot X(t - j\cdot\Delta t, f)$$

where, R(t, f) is the estimated power spectrum of the late reflection sound, $J_0$ is a stating order obtained from the lower limit value of the set duration range, $J_{AR}$ is an order of the AR model obtained from the upper limit value of the duration range, $\alpha_{j,f}$ an estimation parameter of the AR model, X(t−j·Δt, f) is the power spectrum of j frame previous to the current frame, and Δt is an interval between frames.

In another specific implementation manner, the spectral estimation unit 300 is specifically configured to: for several frames previous to the current frame and having a distance from the current frame within a set duration range, perform lineal superposition on the direct sound and early reflection sound components in the power spectra of these frames, by using an MA model, to estimate the power spectrum of the late reflection sound of the current frame.

For example, the power spectrum of the late reflection sound of the current frame is estimated by using the MA model according to the following equation;

$$R(t, f) = \sum_{j=J_0}^{J_{MA}} \beta_{j,f} \cdot Y(t - j \cdot \Delta t, f)$$

where, R(t, f) is the estimated power spectrum of the late reflection sound, $J_0$ is a stating order obtained from the lower limit value of the set duration range, $J_{MA}$ is an order of the MA model obtained from the upper limit value of the set duration range, $\beta_{j,f}$ is an estimation parameter of the MA model, Y(t−j·Δt, f) is the power spectra of a direct sound and an early reflection sound of j frame previous to the current frame, and Δt is an interval between frames.

In another specific implementation manner, the spectral estimation unit 300 is specifically configured to: for several frames previous to the current frame and having a distance from the current frame within a set duration range, perform linear superposition on all components in the power spectra of these frames by using an AR model, and then performing linear superposition on the direct sound and early reflection sound components in the power spectra of these frames by using an MA model, to estimate the power spectrum of the late reflection sound of the current frame.

For example, the power spectrum of the late reflection sound of the current frame is estimated by using the ARMA model according to the following equation:

$$R(t, f) = \sum_{j=J_0}^{J_{AR}} \alpha_{j,f} \cdot X(t - j \cdot \Delta t, f) + \sum_{j=J_0}^{J_{MA}} \beta_{j,f} \cdot Y(t - j \cdot \Delta t, f)$$

where, R(t, f) is the estimated power spectrum of the late reflection sound, $J_0$ is a stating order obtained from the lower limit value of the set duration range, $J_{AR}$ is an order of the AR model obtained from the upper limit value of the set duration range, $\alpha_{j,f}$ is an estimation parameter of the AR model, $J_{MA}$ is an order of the MA model obtained from the upper limit value of the set duration range, $\beta_{j,f}$ is an estimation parameter of the MA model, Y(t−j·Δt, f) is the power spectra of a direct sound and an early reflection sound of j frame previous to the current frame, X(t−j·Δt, f) is the power spectrum of j frame previous to the current frame and Δt is an interval between frames.

There are well-known algorithms for the specific solutions of the AR model, the MA model and the ARMA model, for example, by Yule-Walker equations or Burg algorithm.

The spectral subtraction unit 400 is specifically configured to: obtain a gain function by a spectral subtraction method according to the power spectrum of the late reflection sound; and multiply the gain function by the power spectrum of the current frame to obtain the power spectra of the direct sound and the early reflection sound of the current frame.

After finishing the estimation of the power spectrum R(t, f) of the late reflection sound, a speech signal Y(t, j) after dereverberation may be obtained by a spectral subtraction method:

$$Y(t,f)=G(t,f)\cdot X(t,f)$$

where, $$G(t, f) = \frac{X(t, f) - R(t, f)}{X(t, f)}$$

is the gain function obtained by a spectral subtraction method.

The above description merely illustrates the preferred embodiments of the present invention and is not intended to limit the protection scope of the present invention. Any modification, equivalent replacement and improvement made within the spirit and principle of the present invention shall fall into the protection scope of the present invention.

The invention claimed is:

1. A method for dereverberation of single-channel speech, comprising the steps of:

framing an input single-channel speech signal into several frames, and according to a time sequence of the frames, processing each frame as follows:

performing a short-time Fourier transform on a current frame, and thereby obtaining a power spectrum of the current frame and a phase spectrum of the current frame;

selecting several frames, which are previous to the current frame and which have a distance from the current frame within a set duration range, and performing linear superposition on the power spectra of the selected several frames, and thereby estimating the power spectrum of a late reflection sound of the current frame;

removing the estimated power spectrum of the late reflection sound from the power spectrum of the current frame by a spectral subtraction method, and thereby obtaining a power spectrum of a direct sound of the current frame and a power spectrum of an early reflection sound of the current frame;

performing an inverse short-time Fourier transform on the power spectrum of the direct sound of the current frame, on the power spectrum of the early reflection sound of the current frame, and on the phase spectrum of the current frame, together, and thereby obtaining a dereverberated version of the current frame.

2. The method according to claim 1, wherein an upper limit value of the duration range is set according to attenuation characteristics of the late reflection sound of the current frame;

and/or wherein a lower limit value of the duration range is set according to speech-related characteristics, and according to shock response distribution areas in a reverberation environment of the direct sound of the current frame and of the early reflection sound of the current frame.

3. The method according to claim 2, wherein the upper limit value of the duration range is selected from 0.3 s to 0.5 s.

4. The method according to claim 2, wherein the lower limit value of the duration range is selected from 50 ms to 80 ms.

5. The method according to claim 1, wherein the performing linear superposition comprises:

performing, using an Auto Regressive model, linear superposition on all components in the power spectra of the selected several frames, and thereby estimating the power spectrum of the late reflection sound of the current frame;

or performing, using a Moving Average model, linear superposition on direct sound components in the power spectra of the selected several frames, and on early reflection sound components in the power spectra of the selected several frames, and thereby estimating the power spectrum of the late reflection sound of the current frame;

or performing, using an Auto Regressive model, linear superposition on all components in the power spectra of the selected several frames, and then performing, using a Moving Average model, linear superposition on direct sound components in the power spectra of the selected several frames, and on early reflection sound components in the power spectra of the selected several frames, and thereby estimating the power spectrum of the late reflection sound of the current frame.

6. A device for dereverberation of single-channel speech, comprising:

at least one processing unit, wherein the at least one processing unit is configured to perform operations comprising:

framing an input single-channel speech signal into several frames, and according to a time sequence of the frames, processing each frame as follows:

performing a short-time Fourier transform on a current frame, and thereby obtaining a power spectrum of the current frame and a phase spectrum of the current frame;

selecting several frames, which are previous to the current frame and which have a distance from the current frame within a set duration range, and performing linear superposition on the power spectra of the selected several frames, and thereby estimating the power spectrum of a late reflection sound of the current frame;

removing the estimated power spectrum of the late reflection sound from the power spectrum of the current frame by a spectral subtraction method, and thereby obtaining a power spectrum of a direct sound of the current frame and a power spectrum of an early reflection sound of the current frame;

performing an inverse short-time Fourier transform on the power spectrum of the direct sound of the current frame, on the power spectrum of the early reflection sound of the current frame, and on the phase spectrum of the current frame, together, and thereby obtaining a dereverberated version of the current frame.

7. The device according to claim 6, wherein an upper limit value of the duration range is set according to attenuation characteristics of the late reflection sound of the current frame;

and/or wherein a lower limit value of the duration range is set according to speech-related characteristics, and according to shock response distribution areas in a reverberation environment of the direct sound of the current frame and of the early reflection sound of the current frame.

8. The device according to claim 7, wherein the upper limit value of the duration range is selected from 0.3 s to 0.5 s.

9. The device according to claim 7, wherein the lower limit value of the duration range is selected from 50 ms to 80 ms.

10. The device according to claim 6, wherein the performing linear superposition comprises:

performing, using an Auto Regressive model, linear superposition on all components in the power spectra of the selected several frames, and thereby estimating the power spectrum of the late reflection sound of the current frame;

or performing, using a Moving Average model, linear superposition on direct sound components in the power spectra of the selected several frames, and on early reflection sound components in the power spectra of the selected several frames, and thereby estimating the power spectrum of the late reflection sound of the current frame;

or performing, using an Auto Regressive model, linear superposition on all components in the power spectra of the selected several frames, and then performing, using a Moving Average model, linear superposition on direct sound components in the power spectra of the selected several frames, and on early reflection sound components in the power spectra of the selected several frames, and thereby estimating the power spectrum of the late reflection sound of the current frame.

* * * * *